US011573043B2

(12) United States Patent
Jeong et al.

(10) Patent No.: US 11,573,043 B2
(45) Date of Patent: Feb. 7, 2023

(54) REFRIGERATOR

(71) Applicant: SAMSUNG ELECTRONICS CO., LTD., Suwon-si (KR)

(72) Inventors: Jin Jeong, Yongin-si (KR); Seok Jun Yoon, Suwon-si (KR); Do Yun Jang, Suwon-si (KR); Yeon Woo Cho, Seoul (KR); Kook Jeong Seo, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 66 days.

(21) Appl. No.: 16/652,239

(22) PCT Filed: Sep. 28, 2018

(86) PCT No.: PCT/KR2018/011600
§ 371 (c)(1),
(2) Date: Mar. 30, 2020

(87) PCT Pub. No.: WO2019/066595
PCT Pub. Date: Apr. 4, 2019

(65) Prior Publication Data

US 2020/0240696 A1 Jul. 30, 2020

(30) Foreign Application Priority Data

Sep. 29, 2017 (KR) ..... 10-2017-0127967
Jun. 11, 2018 (KR) ..... 10-2018-0066893

(51) Int. Cl.
*F25C 5/20* (2018.01)
*F25C 1/24* (2018.01)

(52) U.S. Cl.
CPC ..... *F25C 5/22* (2018.01); *F25C 1/24* (2013.01)

(58) Field of Classification Search
CPC ..... F25C 1/24; F25C 5/22; F25C 5/20; F25C 5/24
See application file for complete search history.

(56) References Cited

U.S. PATENT DOCUMENTS 7,975,503 B2 7/2011 Lim et al.
9,448,003 B2 9/2016 Shin et al.
(Continued)

FOREIGN PATENT DOCUMENTS

CN 101512258 8/2009
CN 101512258 A 8/2009
(Continued)

OTHER PUBLICATIONS

Extended European Search Report dated Aug. 28, 2020 in corresponding European Patent Application No. 18860380.7.
(Continued)

*Primary Examiner* — Tavia Sullens
(74) *Attorney, Agent, or Firm* — Staas & Halsey LLP

(57) ABSTRACT

A refrigerator includes a main body, a door rotatably coupled to the main body, and an ice making chamber provided in the door and into which the ice maker is assembled. The ice making chamber includes an ice making chamber wall and an ice making space having an open front surface, and the ice making chamber wall includes a guide rib protruding toward the ice making space. The ice maker includes an ice making tray having an ice making cell for storing water, an ejector rotatable to separate ice from the ice making cell, and a motor box coupled to one side of the ice making tray in a longitudinal direction to accommodate an ice separation motor for rotating the ejector. The ice making tray is supported on the guide rib, and the motor box and the ice making chamber wall is fastened through a fastening member.

15 Claims, 17 Drawing Sheets

(56) References Cited

U.S. PATENT DOCUMENTS

| | | | | |
|---|---|---|---|---|
| 2003/0192336 | A1 | 10/2003 | Kim et al. | |
| 2005/0072167 | A1* | 4/2005 | Oh | F25C 5/22 62/137 |
| 2008/0041089 | A1* | 2/2008 | Choi | F25C 1/24 62/344 |
| 2011/0162406 | A1* | 7/2011 | Shin | F25C 1/24 62/351 |
| 2012/0096872 | A1 | 4/2012 | Cheong et al. | |
| 2013/0263620 | A1* | 10/2013 | An | F25C 5/18 62/340 |
| 2013/0305767 | A1 | 11/2013 | Lee et al. | |
| 2014/0130537 | A1 | 5/2014 | Gu et al. | |
| 2017/0074578 | A1 | 3/2017 | Guo et al. | |

FOREIGN PATENT DOCUMENTS

| | | |
|---|---|---|
| CN | 102455108 A | 5/2012 |
| CN | 102455108 | 5/2021 |
| KR | 10-2005-0110214 | 11/2005 |
| KR | 10-2007-0051974 | 5/2007 |
| KR | 10-2008-0068440 | 7/2008 |
| KR | 10-2010-0020897 | 2/2010 |
| KR | 10-2010-0057216 | 5/2010 |
| KR | 10-2011-0080104 | 7/2011 |
| KR | 10-1731024 | 4/2017 |

OTHER PUBLICATIONS

International Search Report dated Jan. 29, 2019 from International Application No. PCT/KR2018/011600, 3 pages.

Notification of First Office Action Issued by Chinese Patent Office for Chinese Application No. 201880062499.5 dated Jun. 2, 2021.

Chinese Office Action dated Nov. 11, 2021 from Chinese Application No. 201880062499.5.

Korean Office Action dated Nov. 7, 2022 in Korean Patent Application No. 10-2018-0066893 (7 pages; 10 pages English translation).

* cited by examiner

REFRIGERATOR

CROSS-REFERENCE TO RELATED APPLICATIONS

This application is a U.S. National Stage Application which claims the benefit under 35 U.S.C. § 371 of International Patent Application No. PCT/KR2018/011600 filed on Sep. 28, 2018, which claims foreign priority benefit under 35 U.S.C. § 119 of Korean Patent Application No. 10-2017-0127967 filed on Sep. 29, 2017 and Korean Patent Application No. 10-2018-0066893 filed on Jun. 11, 2018 in the Korean Intellectual Property Office, the contents of both of which are incorporated herein by reference.

TECHNICAL FIELD

The present disclosure relates to an icemaker assembly structure of a refrigerator in which an ice making chamber is provided in a door and a guide structure for guiding ice falling into an ice bucket.

BACKGROUND ART

A refrigerator is a home appliance including a main body having a storage chamber, a cold air supply device for supplying cold air to the storage chamber, and a door for opening and closing the storage chamber to keep food in a fresh state.

The refrigerator may further include an ice maker and an ice bucket to make and store ice, and the ice maker and the ice bucket are disposed in an ice making chamber formed in the main body or the door. In general, in the case of a bottom-mounted freezer (BMF) type refrigerator, the ice making chamber is provided at one corner of the inside of a refrigerating chamber or at a rear surface or a front surface of a refrigerating chamber door.

The ice maker is generally assembled to an upper wall of the ice making chamber through a separate supporter member. For example, in the case of a BMF refrigerator in which an ice making chamber is formed inside a refrigerating chamber, the supporter member is coupled to an upper portion of the ice maker, and then the supporter member is again coupled to an upper wall of the ice making chamber to assemble the ice maker into the ice making chamber.

A locking hole is formed in an inner case of the upper wall of the ice making chamber, a ring-shaped locking protrusion is formed on the supporter member to be caught into the locking hole, and the ice maker may be fixed by filling an insulator between the inner case and the outer case of an main body after the locking protrusion of the supporter member is caught into the locking hole of the inner case of the upper wall.

DISCLSOURE

Technical Problem

The present disclosure is directed to providing a refrigerator in which an ice maker is easily assembled into an ice making chamber formed in a front surface of a door.

The present disclosure is directed to providing a refrigerator in which an ice maker is assembled into an ice making chamber with only a fastening member such as a screw without adding a separate supporter member.

The present disclosure is directed to providing a refrigerator in which falling noise and ice breakage occurring when ice produced in an ice maker falls into an ice bucket is reduced.

Technical Solution

One aspect of the present disclosure provides a refrigerator including a main body; a storage chamber provided in the main body; a storage chamber door rotatably coupled to the main body to open and close the storage chamber; an ice making chamber provided in the storage chamber door and including an ice making chamber wall and an ice making space formed by the ice making chamber wall and having an open front surface, wherein the ice making chamber wall comprises a guide rib protruding toward the ice making space; an ice maker provided in the ice making chamber and including an ice making tray having an ice making cell for storing water and supported on the guide rib, an ejector rotatable to separate ice from the ice making cell, and a motor box coupled to one side of the ice making tray in a longitudinal direction to accommodate an ice separation motor for rotating the ejector; and a fastening member configured to fasten the motor box to the ice making chamber wall to fix the ice maker.

The ice making chamber wall may include an upper wall, a lower wall, a left wall, a right wall, and a rear wall, and the guide rib may be formed on the left wall or the right wall.

The guide rib may be formed to extend in a front-rear direction.

The guide rib may be integrally formed with the ice making chamber wall.

The ice making tray may include a cell portion having the ice making cell formed therein, and a guide flange protruding from the cell portion to be supported on the guide rib.

The cell portion and the guide flange may be integrally formed.

The ice making tray may include a pocket portion protruding from the cell portion to receive water to be supplied to the ice making cell, and the guide flange may be positioned below the pocket portion.

The guide flange may include a support portion formed to be placed on an upper surface of the guide rib, and a stopper portion formed to be caught on a front surface of the guide rib.

The ice making chamber wall may include an upper wall, a lower wall, a left wall, a right wall, and a rear wall, and the fastening member may fasten the motor box to the upper wall.

The fastening member may be fastened to be inclined in an upward direction toward the rear.

The upper wall of the ice making chamber may include a coupling rib protruding toward the ice making space and having an insertion hole into which the fastening member is inserted.

The motor box may include a motor box outer wall, and a coupling bracket protruding from the motor box outer wall and having a through hole through which the fastening member penetrates.

The motor box outer wall may be provided with a guide groove formed below the coupling bracket.

The coupling bracket may be formed at a position away from an ice making cell region which is an upper region of the ice making cell.

The refrigerator may further include another fastening member configured to fasten the ice making tray to the ice making chamber wall to fix the ice maker.

An insertion hole into which the fastening member is inserted may be formed on the guide rib.

A through hole through which the fastening member penetrates may be formed on the guide flange.

The refrigerator may further include another guide rib formed on the other of the left wall and the right wall of the ice making chamber in which the guide rib is not formed.

Another aspect of the present disclosure provides a refrigerator including a main body; a storage chamber provided in the main body; a storage chamber door rotatably coupled to the main body to open and close the storage chamber; an ice making chamber formed on a front surface of the storage chamber door to be partitioned from the storage chamber; an ice making chamber door configured to open and close the ice making chamber; an ice maker disposed in the ice making chamber to produce ice; an ice bucket disposed in the ice making chamber to store ice produced in the ice maker, the ice bucket including a bottom surface formed to be inclined from a high end portion to a low end portion; and an ice falling guide configured to guide ice falling from the ice maker to the high end portion of the bottom surface of the ice bucket.

The high end portion may be adjacent to the storage chamber door and the low end portion may be adjacent to the ice making chamber door.

The ice falling guide may be inclined downward from a front end toward a rear end.

The ice maker may include an ice making tray having an ice making cell for receiving water to produce ice, and the ice falling guide may be positioned below the ice making tray.

The ice falling guide may be integrally formed with the ice bucket.

The refrigerator may further include an ice maker cover disposed in the front of the ice maker, and the ice falling guide may be integrally formed with the ice maker cover.

The ice falling guide may be integrally formed with the ice making chamber door.

Advantageous Effects

According to a refrigerator of the present disclosure, an ice maker can be easily assembled into and disassembled from an ice making chamber formed on a front surface of a door.

According to a refrigerator of the present disclosure, an ice maker can be assembled into an ice making chamber without an intervening component and can be assembled directly to a wall of the ice making chamber.

According to a refrigerator of the present disclosure, falling noise and ice breakage occurring when ice produced in an ice maker falls into an ice bucket can be reduced.

MODE OF THE INVENTOIN

Figure 1:
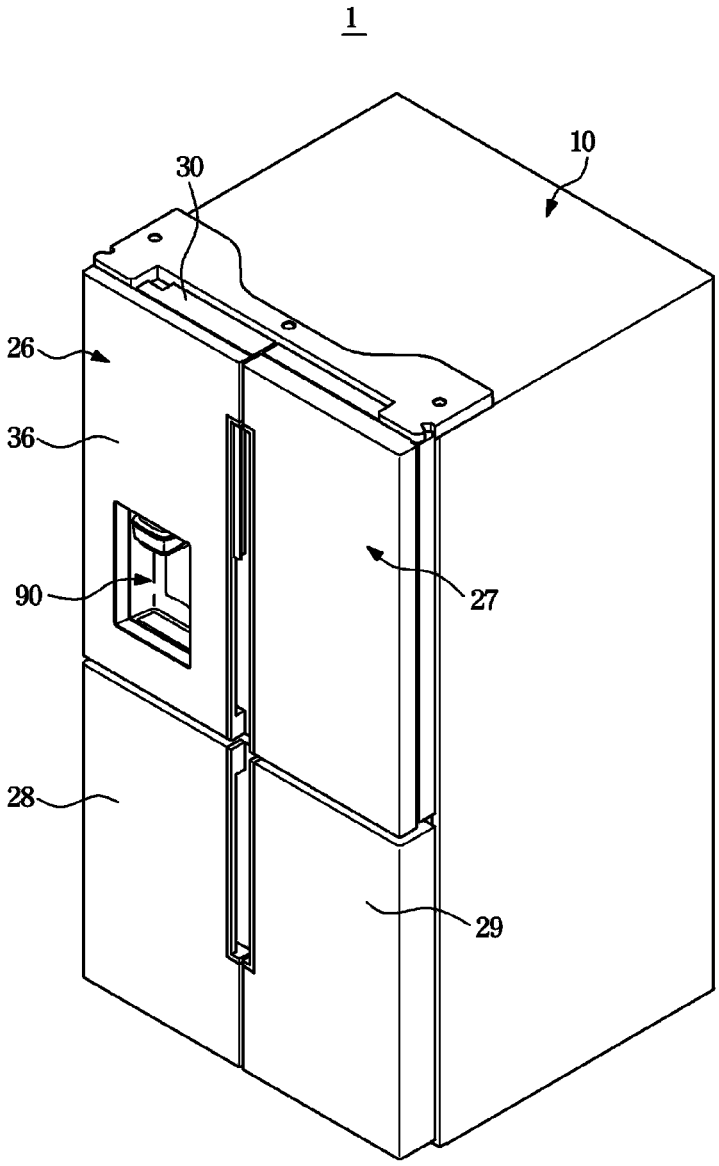
FIG. 1 is a perspective view of a refrigerator according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification, Hereinafter, embodiments of the present disclosure will be described in detail with reference to the accompanying drawings.

Figure 2:
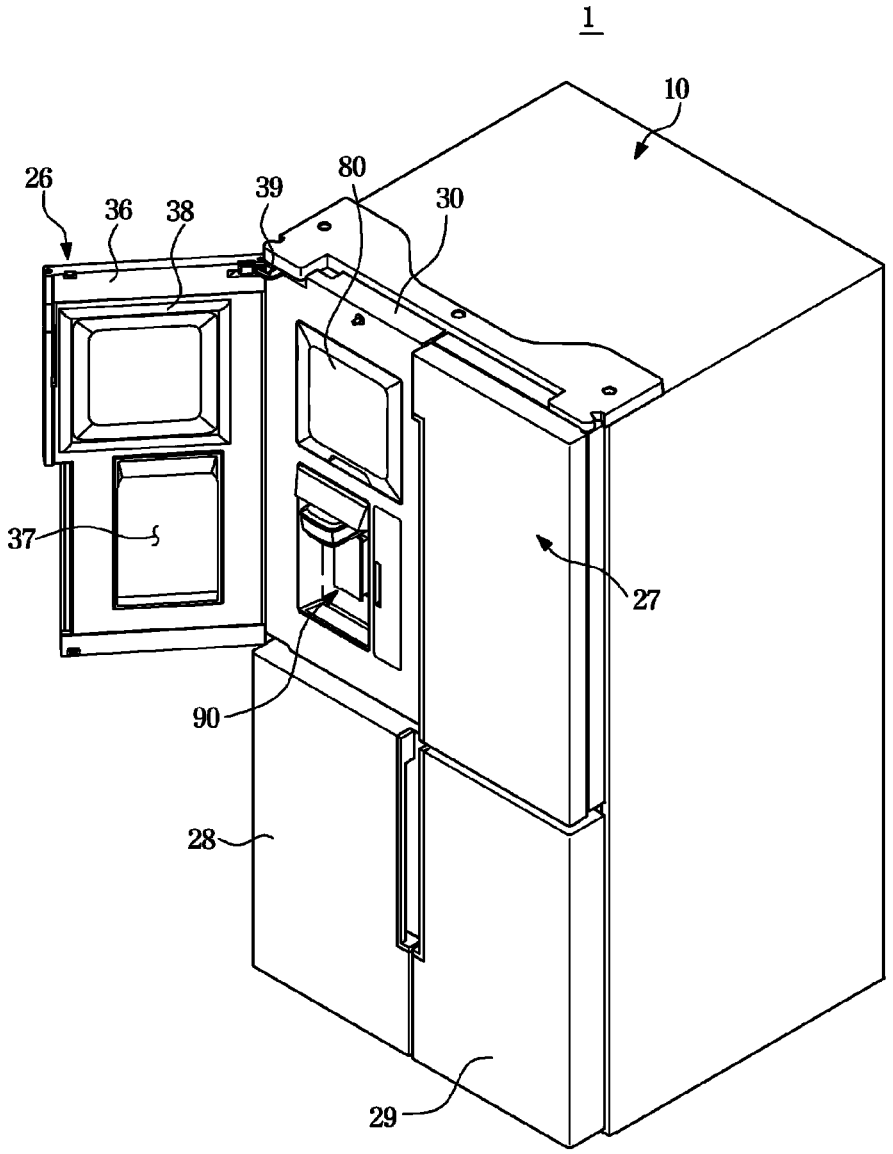
FIG. 2 is a view illustrating a state in which an ice making chamber door of the refrigerator of FIG. 1 is opened.
Figure 3:
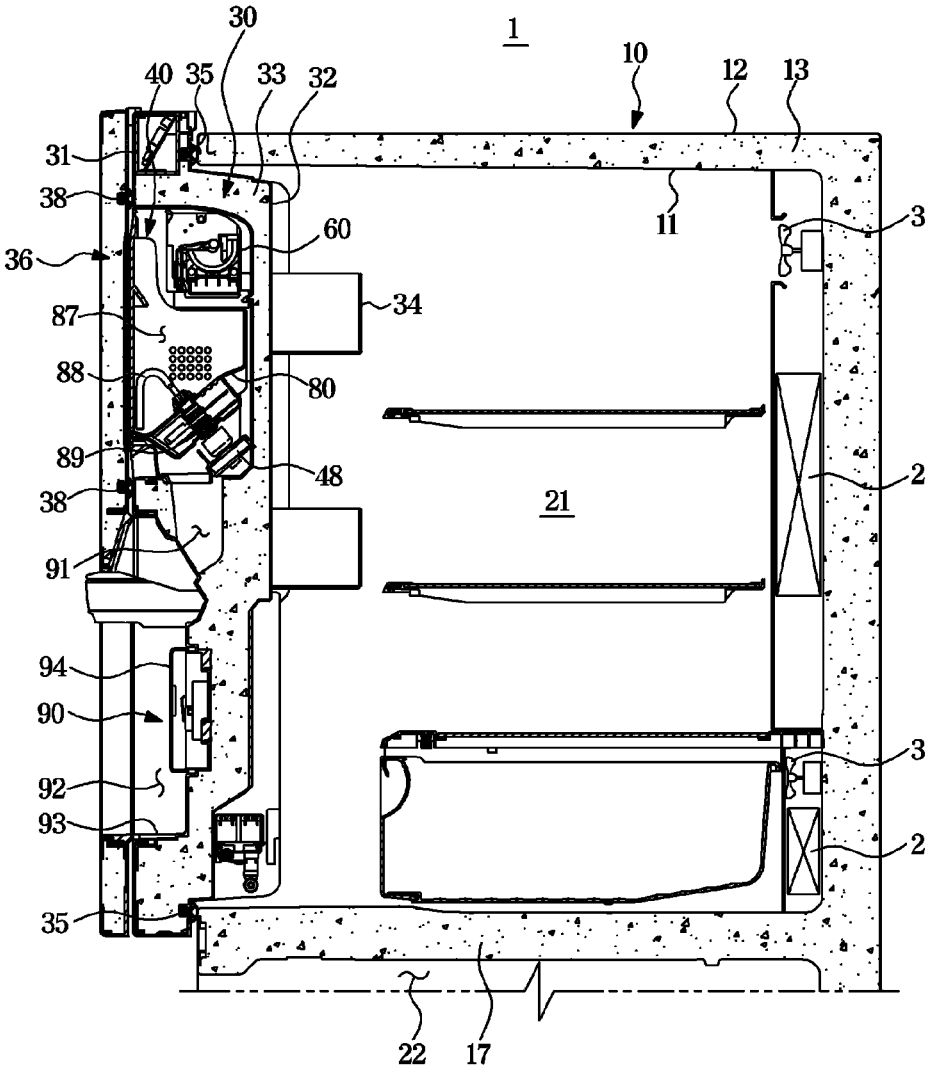
FIG. 3 is a side cross-sectional view illustrating main components of the refrigerator of FIG. 1.
Figure 4:
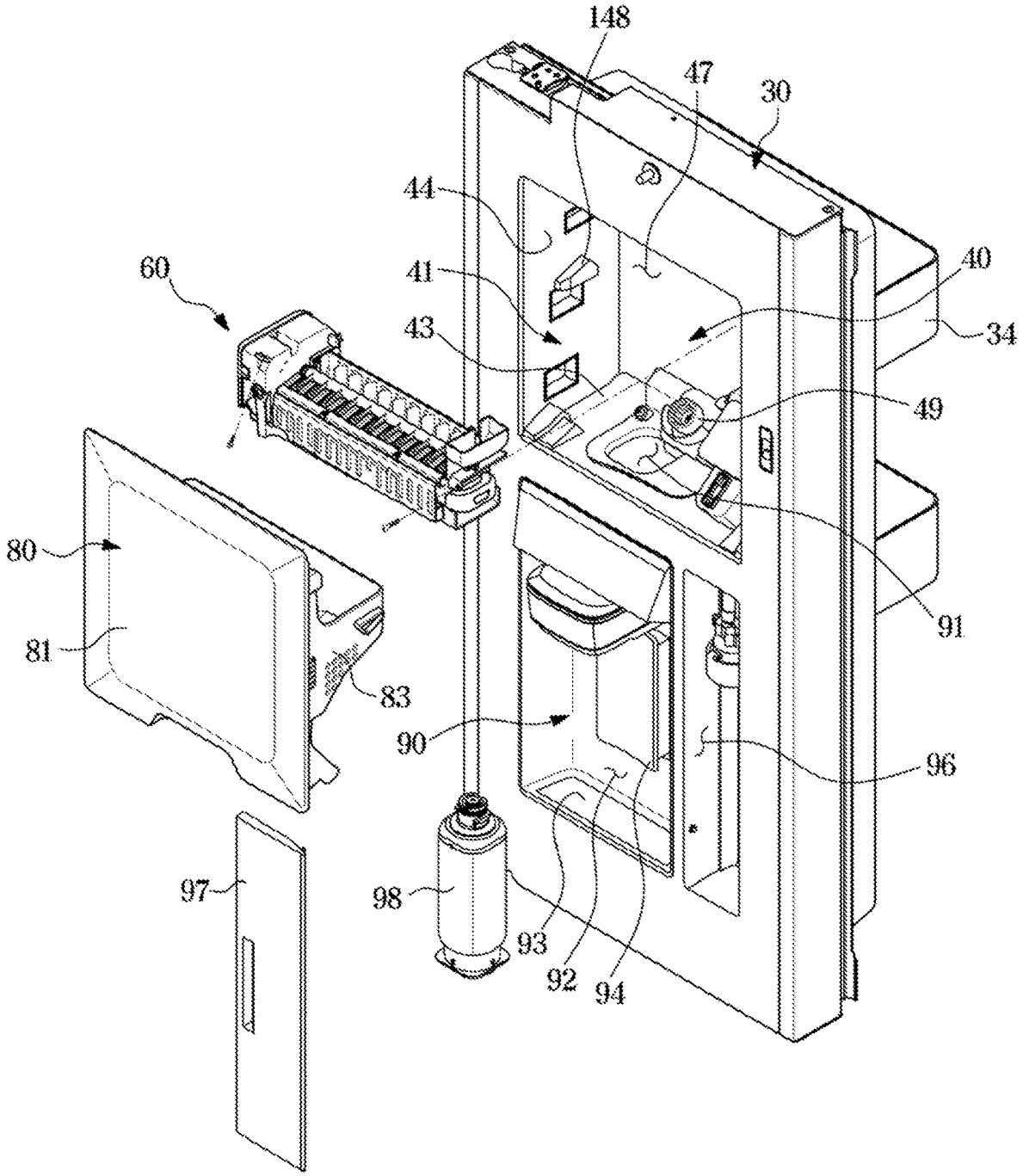
FIG. 4 is an exploded perspective view illustrating a storage chamber door and an ice making chamber of the refrigerator of FIG. 1.

FIG. 1 is a perspective view of a refrigerator according to an embodiment of the present disclosure. FIG. 2 is a view illustrating a state in which an ice making chamber door of the refrigerator of FIG. 1 is opened. FIG. 3 is a side cross-sectional view illustrating main components of the refrigerator of FIG. 1. FIG. 4 is an exploded perspective view illustrating a storage chamber door and an ice making chamber of the refrigerator of FIG. 1.

Referring to FIGS. 1 to 4, a refrigerator 1 may include a main body 10 having storage chambers 21 and 22, door units 26, 27, 28 and 29 provided in the front of the storage chambers 21 and 22, an ice making chamber 40 provided in the door unit 26, an ice maker 60 and an ice bucket 80 arranged in the ice making chamber 40, and a cold air supply device configured to supply cold air to the storage chambers 21 and 22 and the ice making chamber 40.

The cold air supply device may include an evaporator 2, a compressor (not shown), a condenser (not shown), and an expanding device (not shown), and may generate cold air by using evaporative latent heat of a refrigerant. The cold air generated in the evaporator 2 may be supplied to the storage chamber 21 and the ice making chamber 40 by an operation of a blowing fan 3. The refrigerator 1 may include a cold air duct (not shown) to guide the cold air generated in the evaporator 2 to the ice making chamber 40.

The main body 10 may include an inner case 11 forming the storage chambers 21 and 22, an outer case 12 coupled to an outer side of the inner case 12 and forming an outer appearance of the refrigerator 1, and an insulator 13 provided between the inner case 11 and the outer case 12 to insulate the storage chambers 21 and 22. The inner case 11 may be formed by injection molding a plastic material, and the outer case 12 may be formed of a metal material. Urethane foam insulation may be used as the insulator 13, and a vacuum insulation panel may be used together as needed.

The main body 10 may include an intermediate wall 17 and the storage chambers 21 and 22 may be partitioned into the upper storage chamber 21 and the lower storage chamber 22 by the intermediate wall 17. The intermediate wall 17 may include an insulator, and the upper storage chamber 21 and the lower storage chamber 22 may be insulated from each other by the insulator.

The upper storage chamber 21 may be used as a refrigerating chamber for storing food in a refrigerating mode by maintaining indoor air at a temperature of about 0 to 5 degrees Celsius, and the lower storage chamber 22 may be used as a freezing chamber for storing food in a freezing mode by maintaining indoor air at a temperature of about 0 to −30 degrees Celsius.

The storage chambers 21 and 22 may have an open front to allow food to be received and withdrawn, and the open front of the storage chambers 21 and 22 may be opened and closed by the door units 26, 27, 28, and 29 rotatably provided in the front of the storage chambers 21 and 22. The storage chamber 21 may be opened and closed by the door units 26 and 27, and the storage chamber 22 may be opened and closed by the door units 28 and 29.

The door unit 26 may include an storage chamber door 30 rotatably coupled to the main body 10 to open and close the storage chamber 21 and an ice making chamber door 36 rotatably provided in the front of the storage chamber door 30. The storage chamber door 30 may be rotatably coupled to the main body 10 by a hinge member (not shown).

The ice making chamber door 36 may be rotatably coupled to the storage chamber door 30 or the main body 10 by a hinge member 39. The storage chamber door 30 and the ice making chamber door 36 may be configured to be rotatable in the same direction.

The ice making chamber door 36 may have a size corresponding to a size of the storage chamber door 30. Thus, when the storage chamber door 30 and the ice making chamber door 36 are both closed, only a dispenser 90 may be exposed to the outside through an opening 37 of the ice making chamber door 36, and the other portions of the storage chamber door 30 may be covered by the ice making chamber door 36 not to exposed.

The ice making chamber 40 may be provided on a front side of the storage chamber door 30. The ice making chamber 40 may be partitioned, separated, and independent from the storage chamber 21 by the storage chamber door 30.

The storage chamber door 30 may include a front plate 31, a rear plate 32 coupled to the rear of the front plate 31, and an insulator 33 provided between the front plate 31 and the rear plate 32, and the ice making chamber 40 may be formed by recessing a portion of the front plate 31 toward the insulator 33. The ice making chamber 40 may be formed to have an open front. The open front of the ice making chamber 40 may be opened and closed by the ice making chamber door 36.

Urethane foam insulation may be used as the insulator 33, as in the insulator 13 of the main body 10, and a vacuum insulation panel may be used together as needed. The ice making chamber 40 may be insulated from the storage chamber 21 of the main body 10 by the insulator 33.

The ice making chamber 40 may be provided with the ice maker 60 to make ice and an ice bucket 80 to store ice produced in the ice maker 60. A detailed structure of the ice maker 40 is described later.

The ice bucket 80 may be detachably disposed in the ice making chamber 40. Protrusions 82*a* and 82*b* may be formed on both left and right sides of the ice bucket 80, and the bucket support ribs 148 may be formed in the ice making chamber 40 to support the protrusions 82*a* and 82*b*. The ice bucket 80 may include a wall portion composed of a front surface portion 81, a left surface portion 82, a right surface portion 83, a rear surface portion 84, and a bottom surface 85, and an ice storage space 87 formed inside the wall portion (refer to FIGS. 12 and 13).

The ice bucket 80 may be provided with a rotatable transfer member 88 to stir and transfer ice and a crushing blade 89 to crush the ice. A transfer motor 48 for driving the transfer member 88 is provided in the ice making chamber 40, the transfer member 88 and the transfer motor 48 may be connected when the ice bucket 80 is mounted to the ice making chamber 40 and may be disconnected when the ice bucket 80 is separated from the ice making chamber 40. To this end, couplers 88*a* and 49 may be provided at the transfer member 88 and the transfer motor 48, respectively.

A discharge port 86 (FIG. 13) is formed at a lower portion of the ice bucket 80 to discharge the stored ice, and the ice discharged from the ice bucket 80 may be transferred to a dispensing space 92 through a chute 91.

With this configuration, a user may access the ice making chamber 40 by only opening the ice making chamber door 36 without having to open the storage chamber door 30. Therefore, the ice may be easily taken out of the ice bucket 80 and the ice bucket 80 may be easily repaired, cleaned and replaced by separating the ice bucket 80 from the ice making chamber 40. In addition, the storage chamber door 30 may be kept closed when the user accesses the ice making chamber 40, thereby preventing cold air from leaking out of the storage chamber 21 and saving energy.

The storage chamber door 30 may include the dispenser 90 to provide water and ice to the user. The dispenser 90 may include the dispensing space 92 recessed to receive water and ice, a dispensing tray 93 provided in the dispensing space 92 to place a container such as a cup thereon, and a dispensing switch 94 to input an operational command into the dispenser.

The storage chamber door 30 may include the chute 91 connecting the ice making chamber 40 and the dispensing space 92 to guide the ice in the ice bucket 80 to the dispensing space 92.

The ice making chamber door 36 may have an opening 37 to allow access to the dispenser 90 of the storage chamber door 30 in a state in which the ice making chamber door 36 is closed. The opening 37 may be formed at a position corresponding to the dispenser 90.

A door guard 34 for storing food may be provided on a rear surface of the storage chamber door 30. A gasket 35, which is in close contact with a front surface of the main body 10 to seal the storage chamber 21, may be provided at the rear surface of the storage chamber door 30, and a gasket 38, which is in close contact with a front surface of the storage chamber door 30 to seal the ice making chamber 40, may be provided at a rear surface of the ice making chamber door 36.

The refrigerator 1 may include a water filter 98 to purify water and a water tank (not shown) to refrigerate and store the water purified by the water filter 98. A water filter accommodating portion 96 may be formed in the storage chamber door 30 to accommodate the water filter 98. The water filter accommodating portion 96 may be formed on the front surface of the storage chamber door 30 to allow the user to access in a state in which the storage chamber door 30 is closed and only the ice making chamber door 36 is opened. The water filter accommodating portion 96 may be formed such that a front surface thereof is opened, and a water filter cover 97 may be detachably provided on the open front surface of the water filter accommodating portion 96.

Hereinafter, the ice making chamber 40, the structure of the ice maker 60, and the assembling structure of the ice maker 60 into the ice making chamber 40, in the refrigerator according to an embodiment of the present disclosure, will be described in detail.

Figure 5:
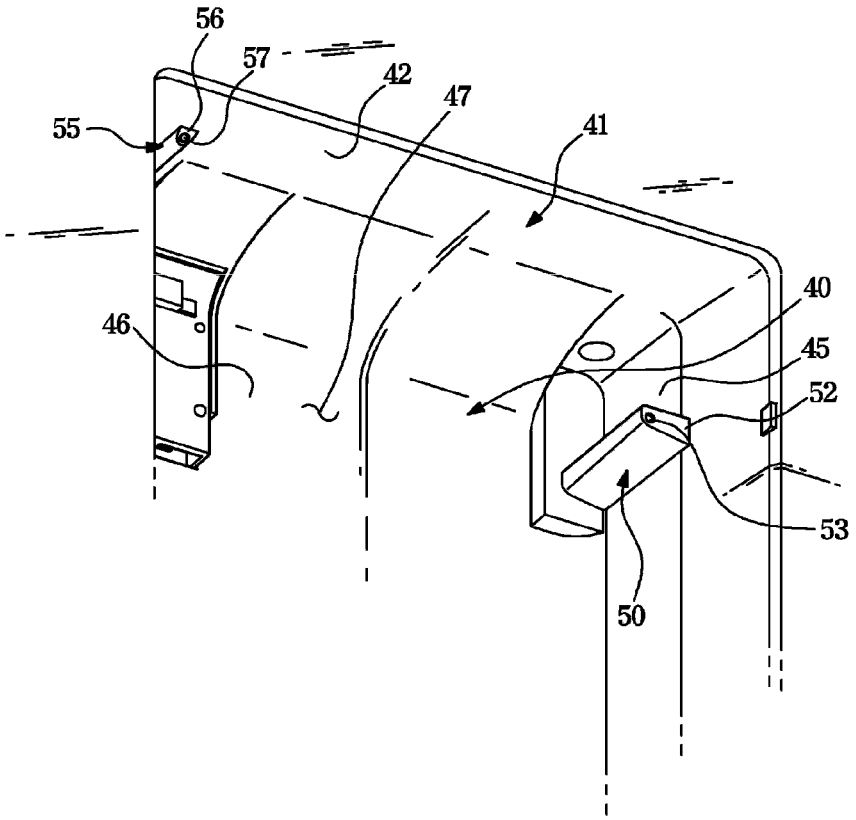
FIG. 5 is a bottom perspective view illustrating the ice making chamber of the refrigerator of FIG. 1.
Figure 6:
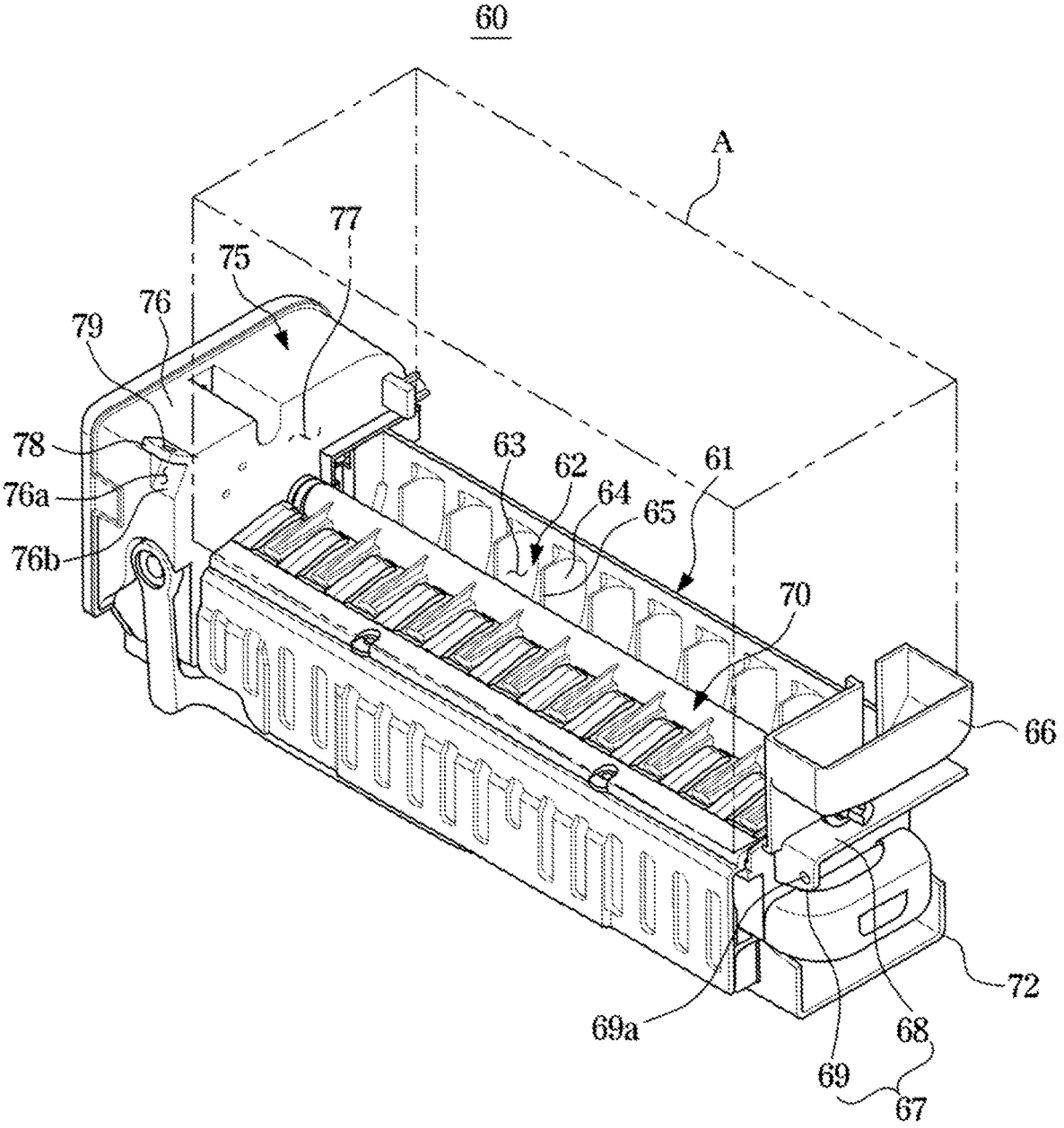
FIG. 6 is a perspective view illustrating an ice maker of the refrigerator of FIG. 1.
Figure 7:
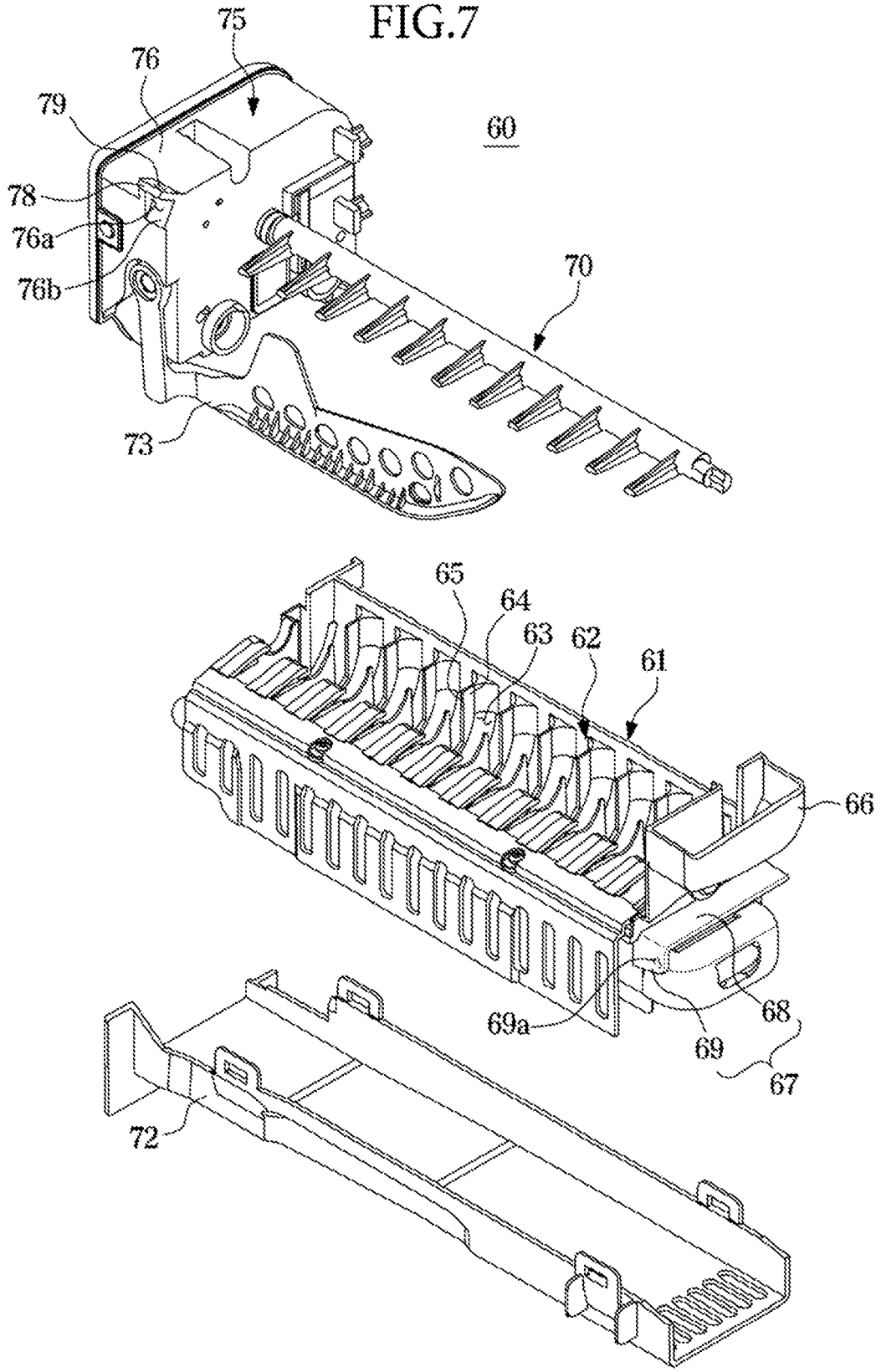
FIG. 7 is an exploded perspective view illustrating the ice maker of the refrigerator of FIG. 1.
Figure 8:
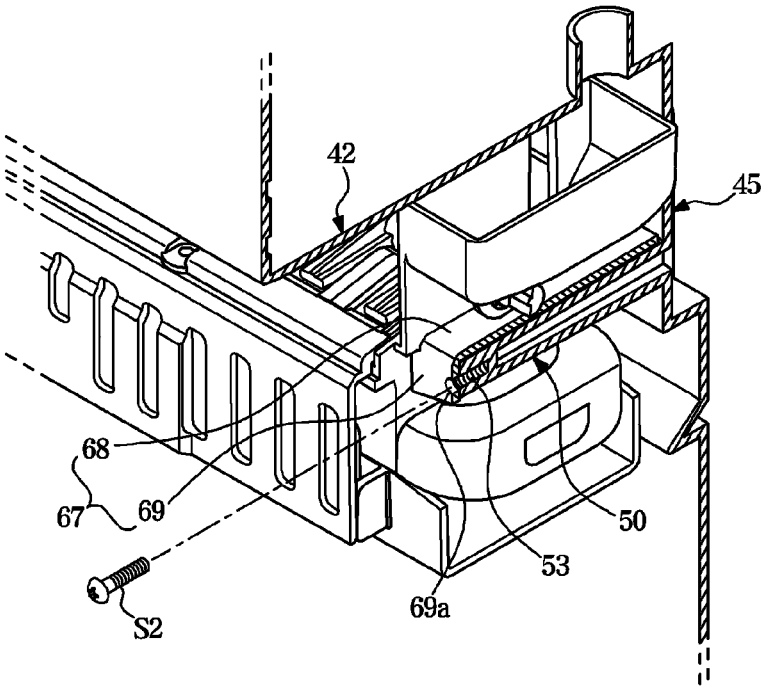
FIG. 8 is a view illustrating a structure in which an ice making tray of the refrigerator of FIG. 1 is supported on and fastened to a guide rib.
Figure 9:
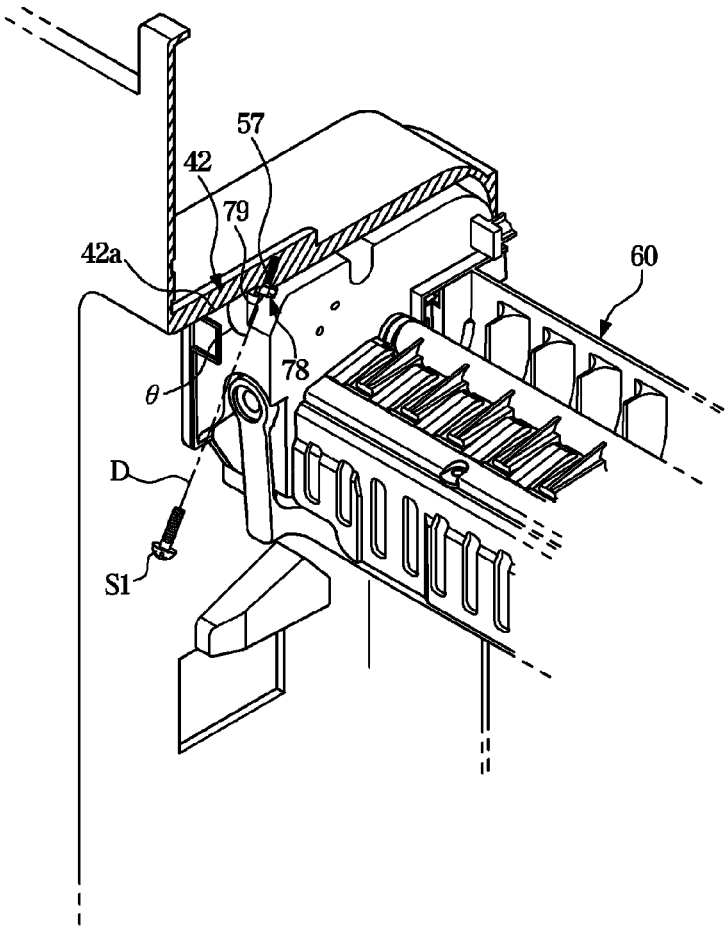
FIG. 9 is a view illustrating a structure in which a motor box and a coupling rib of the refrigerator of FIG. 1 are fastened by a fastening member.
Figure 10:
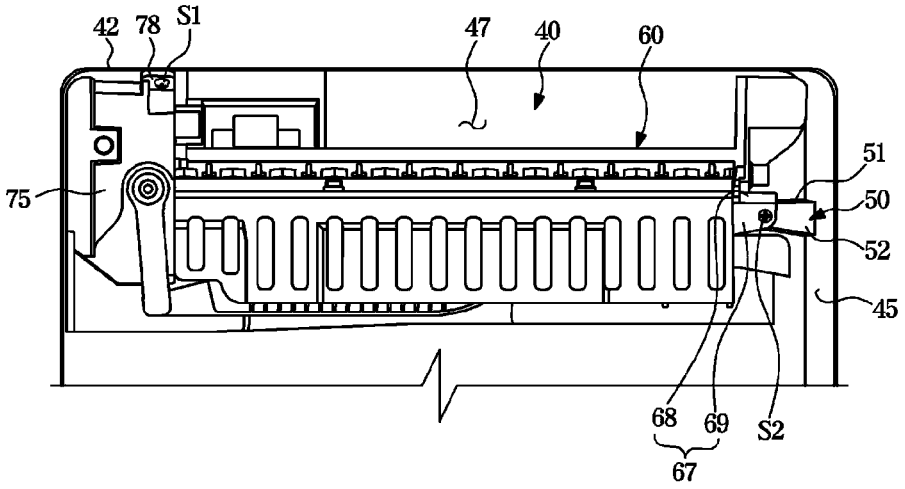
FIG. 10 is a front view illustrating a state in which the ice maker is assembled into the ice making chamber of the refrigerator of FIG. 1.

FIG. 4 is an exploded perspective view illustrating a storage chamber door and an ice making chamber of the refrigerator of FIG. 1. FIG. 5 is a bottom perspective view illustrating the ice making chamber of the refrigerator of FIG. 1. FIG. 6 is a perspective view illustrating an ice maker of the refrigerator of FIG. 1. FIG. 7 is an exploded perspective view illustrating the ice maker of the refrigerator of FIG. 1. FIG. 8 is a view illustrating a structure in which an ice making tray of the refrigerator of FIG. 1 is supported on and fastened to a guide rib. FIG. 9 is a view illustrating a structure in which a motor box and a coupling rib of the refrigerator of FIG. 1 are fastened by a fastening member. FIG. 10 is a front view illustrating a state in which the ice maker is assembled into the ice making chamber of the refrigerator of FIG. 1.

As illustrated in FIGS. 3 to 4, the ice making chamber 40 includes an ice making chamber wall 41 and an ice making space 47 formed by the ice making chamber wall 41. The ice making chamber wall 41 may include an upper wall 42, a lower wall 43, a left wall 44, a right wall 45, and a rear wall 46. The ice making space 47 may be formed such that a front surface thereof is opened.

The ice making chamber 40 includes a guide rib 50 to support an ice making tray 61. Although the present embodiment and drawings illustrate that the guide rib 50 is provided on the right wall 45 of the ice making chamber 40, on the contrary, the guide rib 50 may be provided on the left wall 44 of the ice making chamber 40. The guide rib 50 may support one end in a longitudinal direction of the ice making tray 61. The guide rib 50 may serve to guide the position of the ice making tray 61 when a fastening member S1, which will be described later, is fastened.

The guide rib 50 may be formed to extend in a front-rear direction. The guide rib 50 may be integrally formed with the ice making chamber wall. Alternatively, the guide rib 50 may be formed separately and attached to the ice making chamber wall.

The ice maker 60 may include the ice making tray 61 having an ice making cell 63 provided to accommodate water, an ejector 70 rotatably provided to separate an ice cube from the ice making cell 63, an ice separation motor 74 (FIG. 14) provided to rotate the ejector 70, a motor box 75 provided to accommodate an ice separation motor, a side cover 71 attached to a side portion of the ice making tray 61, a lower cover 72 attached to a lower portion of the ice making tray 61, and a detection lever 73 provided to detect whether the ice bucket 80 is full with ice cubes. With this configuration, the ice maker may automatically perform a series of operations such as water supply, cooling, ice separating, and ice level detection.

Specifically, the ice making tray 61 may include the plurality of ice making cells 63, partitions 64 to partition the plurality of ice making cells 63 from each other, and a cell portion 62 having a passage groove 65 formed on the partitions 64 to allow water to flow between the partitions 64. The ice making tray 61 may include a pocket portion 66 provided at one side of the cell portion 62 in the longitudinal direction to receive water to be supplied to the ice making cells 63.

The ice making tray 61 may include a guide flange 67 protruding from one end of the cell portion 62 in the longitudinal direction to be supported on the guide rib 50 of the ice making chamber 40. The guide flange 67 may be positioned below the pocket portion 66.

The guide flange 67 may include a support portion 68 placed on an upper surface 51 (FIG. 10) of the guide rib 50 to support the load of the ice making tray 61, and a stopper portion 69 interfering with an front surface 52 of the guide rib 50 to limit an entering distance of the ice making tray 61. The stopper portion 69 may extend downward from a front end of the support portion 68.

The guide flange 67 may be integrally formed with the cell portion 62. However, the guide flange 67 may be formed separately and coupled to the cell portion 62.

With this configuration, when the ice maker 60 assembled into the ice making chamber 40, the guide flange 67 of the ice making tray 61 is first placed on the guide rib 50 and the fastening member S1, which will be described later, is fastened, so that the ice maker 60 may be fixed.

The motor box 75 may include a motor box outer wall 76 having a motor accommodating space 77 formed therein, and a coupling bracket 78 protruding from the motor box outer wall 76 to be coupled to the ice making chamber wall 41. The coupling bracket 78 may be provided with a through hole 79 through which the fastening member S1 (also referred to as a fastener) penetrates. The fastening member S1 may include a screw, a bolt, a pin, a rivet, and the like.

The motor box 75 may be fastened to the upper wall 42 of the ice making chamber wall 41. This is because the ice maker 60 is disposed at an upper portion of the ice making chamber 40, and the coupling of the motor box 75 to the upper wall 42 rather than the side walls 44 and 45 has the convenience of assembling work.

The fastening member S1 may be fastened inclined in the upward direction toward the rear when the motor box 75 is fastened to the ice making chamber upper wall 42. That is, as illustrated in FIG. 9, a direction D in which the fastening member S1 is fastened and an inner surface 42*a* of the upper wall of the ice making chamber may have an inclination of a predetermined angle θ. This is because fastening in an oblique direction at the time of fastening the fastening member S1 is more convenient for assembling than fastening in a vertical direction from the bottom. To this end, the coupling bracket 78 of the motor box 75 may be formed to be inclined toward a front upper side. The coupling bracket 78 may be integrally formed with the motor box outer wall 76.

The motor box 75 may have a guide groove 76*a* formed below the coupling bracket 78. The fastening member S1 may be easily guided to the coupling bracket 78 through the guide groove 76*a*. A portion of a corner of the motor box 75 is recessed to form an inclined surface 76*b*, and the guide groove 76*a* may be formed between the inclined surface 76*b* and the coupling bracket 78.

The ice making chamber 40 may include a coupling rib 55 provided to allow the coupling bracket 78 to be supported and to allow the fastening member S1 to be inserted. The coupling rib 55 may be formed on the ice making chamber upper wall 42 to protrude toward the ice making space 47.

The coupling bracket 78 is in close contact with a front surface 56 of the coupling rib 55, and thus, the front surface 56 of the coupling rib 55 may also be inclined at an angle corresponding to the coupling bracket 78. The coupling rib 55 may have an insertion hole 57 into which the fastening member S1 is inserted. Threads may be formed on an inner circumferential surface of the insertion hole 57 to correspond to threads of an outer circumferential surface of the fastening member S1.

It is appropriate that the coupling bracket 78 and the coupling rib 55 are formed at a position away from an ice making cell region A (FIG. 6), which is substantially an upper region of the ice making cell 63. This is to prevent the fastening member S1 from falling into the ice making cell 63 when an operator accidentally drops the fastening member S1 during the work of fastening the coupling bracket 78 and the coupling rib 55 through the fastening member S1.

The ice making tray 61 may also be fastened to the ice making chamber wall 41. Specifically, the guide rib 50 is formed with an insertion hole 53 into which a fastening member S2 is inserted and the guide flange 67 of the ice making tray 61 is formed with a through hole 69*a* through which the fastening member S2 penetrates, so that the ice making tray 61 may be fastened to the ice making chamber wall 41 by the fastening member S2.

However, unlike the present embodiment, the fastening member S2 may be omitted. That is, only the motor box 75 may be fastened to the ice making chamber wall 41.

Figure 11:
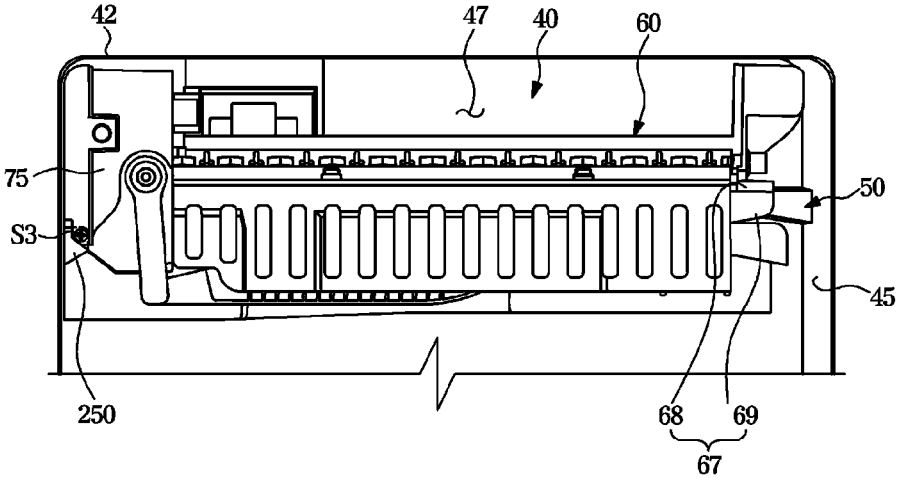
FIG. 11 is a front view illustrating a state in which an ice maker is assembled into an ice making chamber of a refrigerator according to another embodiment of the present disclosure.

FIG. 11 is a front view illustrating a state in which an ice maker is assembled into an ice making chamber of a refrigerator according to another embodiment of the present disclosure.

An icemaker assembly structure of a refrigerator according to another embodiment of the present disclosure will be described with reference to FIG. 11. The same reference numerals are assigned to the same components as in the above-described embodiment, and descriptions thereof may be omitted.

In the above-described embodiment, the guide rib 50 is provided on the right wall 45 of the ice making chamber 40, but a guide rib 250 may be additionally provided on the left wall 44 of the ice making chamber 40 which is the opposite side. The guide rib 250 may support the motor box 75. A through hole through which a fastening member S3 penetrates may be formed on the guide rib 250, and an insertion hole into which the fastening member S3 is inserted may be formed on the motor box 75.

Figure 12:
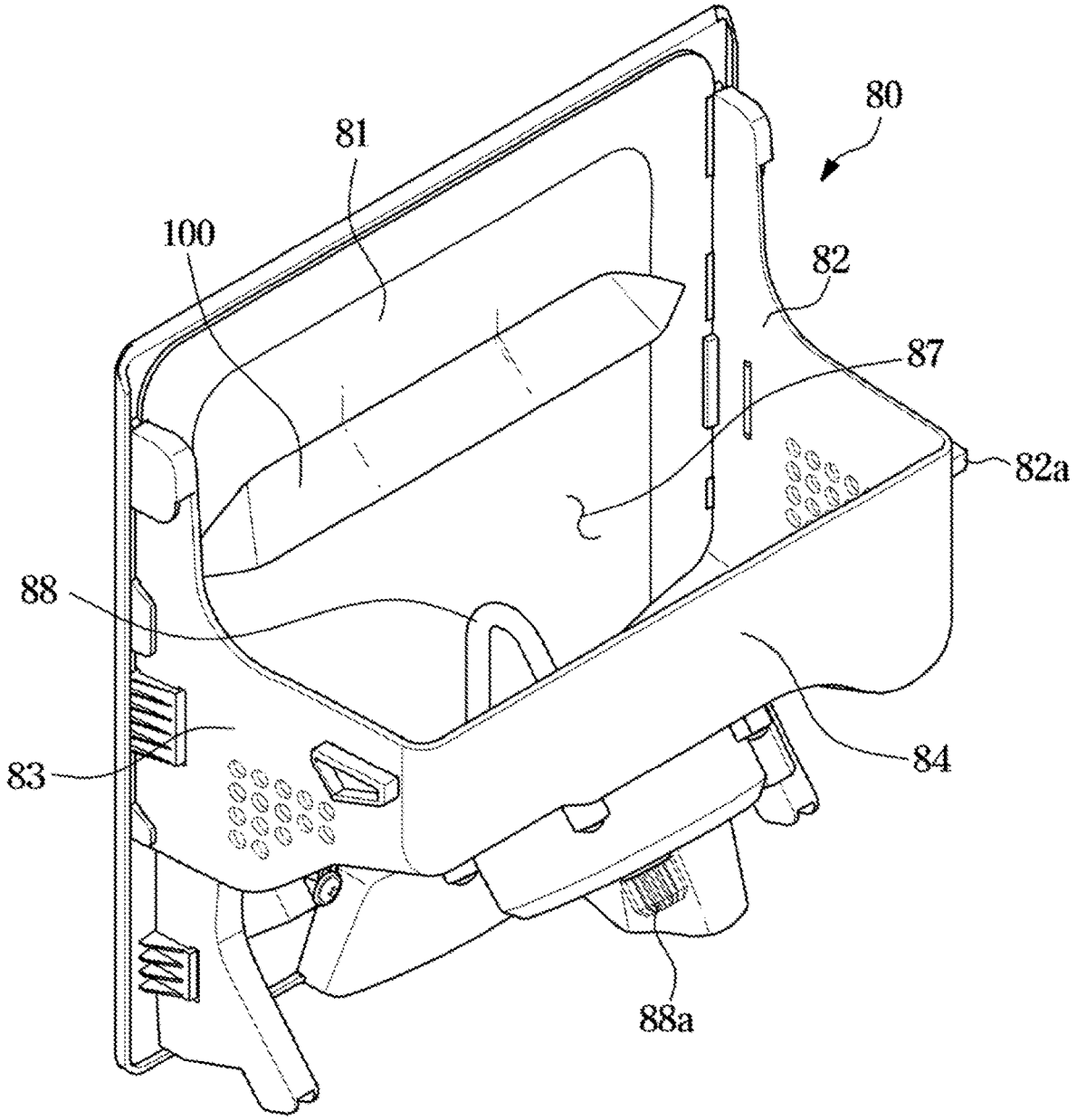
FIG. 12 is a perspective view illustrating an ice bucket of the refrigerator of FIG. 1.
Figure 13:
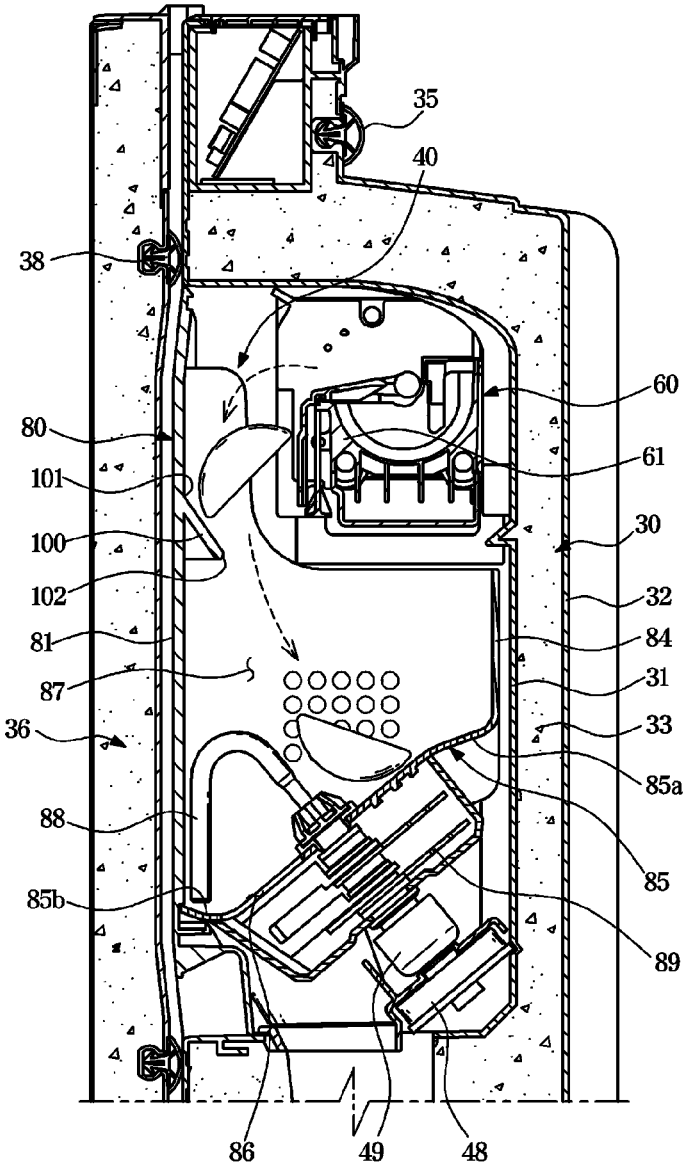
FIG. 13 is an enlarged view of a portion of FIG. 3.
Figure 14:
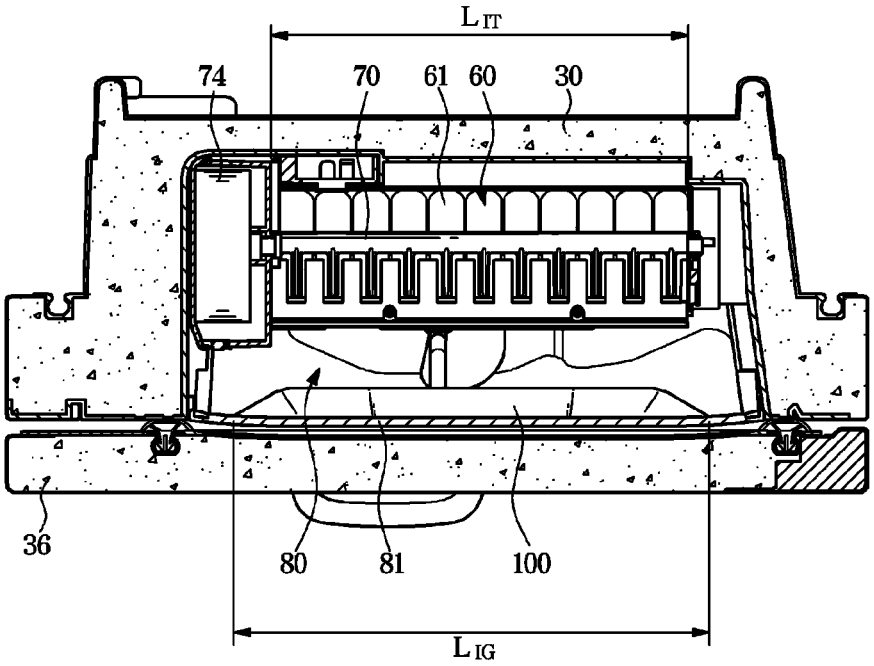
FIG. 14 is a plan view illustrating the ice making tray and an ice falling guide of the refrigerator of FIG. 1.
Figure 15:
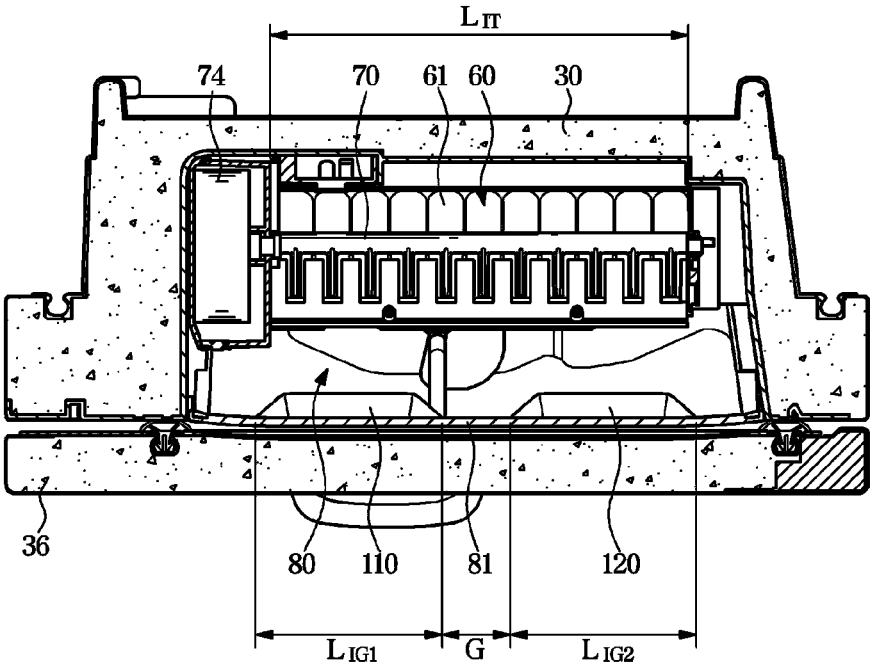
FIG. 15 is a plan view illustrating a structure in which a plurality of the ice falling guides of FIG. 14 is provided.

FIG. 12 is a perspective view illustrating an ice bucket of the refrigerator of FIG. 1. FIG. 13 is an enlarged view of a portion of FIG. 3. FIG. 14 is a plan view illustrating the ice making tray and an ice falling guide of the refrigerator of FIG. 1. FIG. 15 is a plan view illustrating a structure in which a plurality of the ice falling guides of FIG. 14 is provided.

An ice falling guide according to an embodiment of the present disclosure will be described with reference to FIGS. 12 to 15.

According to an embodiment of the present disclosure, the bottom surface 85 of the ice bucket 80 has a high end portion 85*a* and a low end portion 85*b* and may be formed to be inclined from the high end portion 85*a* to the low end portion 85*b*. The high end portion 85*a* may be positioned adjacent to the storage chamber door 30, and the low end portion 85*b* may be positioned adjacent to the ice making chamber door 36.

In such a structure, when the ice produced in the ice maker 60 falls into the ice bucket 80, a great impact may occur in a case where the ice falls to the low end portion 85 side of the bottom surface 85. Accordingly, a great noise may occur and ice may be broken.

According to an embodiment of the present disclosure, the refrigerator 1 may include an ice falling guide 100 to guide ice falling from the ice maker 60 to the high end portion 85*a* side of the bottom surface 85 of the ice bucket 80 in order to reduce the ice falling noise and ice breakage.

The ice falling guide 100 may be positioned below the ice making tray 61 and adjacent to the ice making chamber door 36.

Specifically, the ice falling guide 100 may be integrally formed with the ice bucket 80. The ice falling guide 100 may protrude from the front surface portion 81 of the ice bucket 80 to the ice storage space 87 side of the ice bucket 80. The ice falling guide 100 may be inclined downward from a front end 101 toward a rear end 102.

The ice falling guide 100 may extend in the longitudinal direction (i.e., left-right direction) of the ice making tray 61, and a length LIG of the ice falling guide 100 may be about 30% or more greater than a length LIT of the ice making tray 61.

Figure 16:
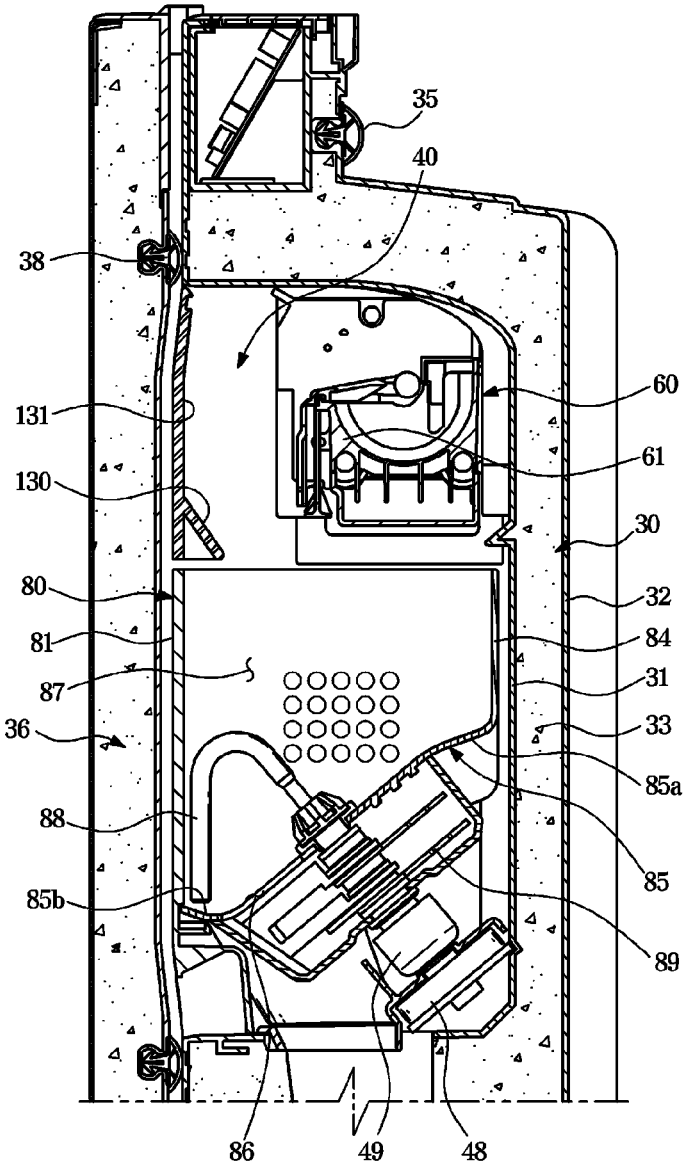
FIG. 16 is a cross-sectional view illustrating an ice falling guide according to another embodiment of the present disclosure.

A plurality of the ice falling guide 100 may be provided. That is, as illustrated in FIG. 15, a plurality of ice falling guides 110 and 120 may be provided in the refrigerator 1. The plurality of ice falling guides 110 and 120 may be arranged in the longitudinal direction of the ice making tray 61, and a predetermined gap G may be formed between the plurality of ice falling guides 110 and 120. The sum of a length LIG1 of the ice falling guide 110 and a length LIG2 of the ice falling guide 120 may be about 3% or more greater than the length LIT of the ice making tray 61. FIG. 16 is a cross-sectional view illustrating an ice falling guide according to another embodiment of the present disclosure.

An ice falling guide according to another embodiment of the present disclosure will be described with reference to FIG. 16. The same reference numerals are assigned to the same components as in the above-described embodiment, and descriptions thereof may be omitted.

An ice falling guide 130 may be integrally formed with an ice maker cover 131. The ice maker cover 131 may be provided as a separate component from the ice bucket 80 and may be provided in the front of the ice maker 60 to cover the ice maker 60.

The ice falling guide 130 may protrude toward the ice storage space 87 of the ice bucket 80 from the ice maker cover 131. The ice falling guide 130 may be inclined downward from a front end toward a rear end.

Figure 17:
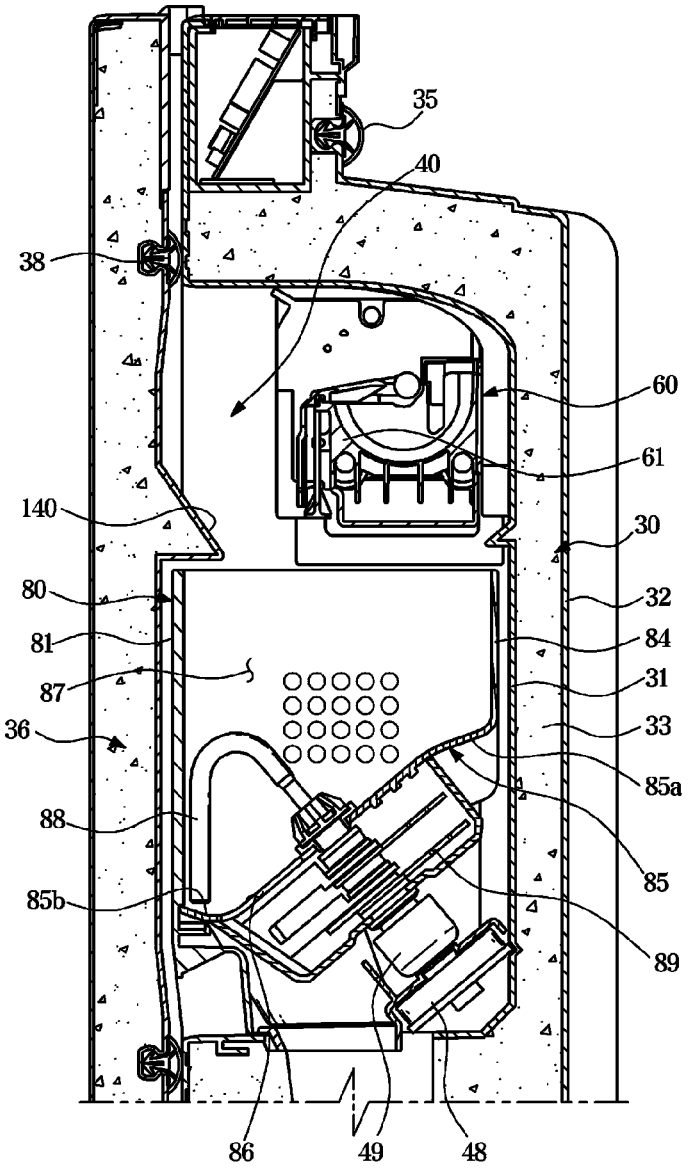
FIG. 17 is a cross-sectional view illustrating an ice falling guide according to another embodiment of the present disclosure.

FIG. 17 is a cross-sectional view illustrating an ice falling guide according to another embodiment of the present disclosure.

An ice falling guide according to another embodiment of the present disclosure will be described with reference to FIG. 17. The same reference numerals are assigned to the same components as in the above-described embodiment, and descriptions thereof may be omitted.

An ice falling guide 140 may be integrally formed with the ice making chamber door 36. The ice falling guide 140 may protrude toward the ice storage space 87 of the ice bucket 80 from the ice making chamber door 36. The ice falling guide 140 may be inclined downward from a front end toward a rear end.

While the present disclosure has been particularly described with reference to exemplary embodiments, it should be understood by those of skilled in the art that various changes in form and details may be made without departing from the spirit and scope of the present disclosure.

The invention claimed is:

1. A refrigerator comprising:

a main body;

a storage chamber provided in the main body;

a storage chamber door rotatably coupled to the main body to open and close the storage chamber;

an ice making chamber provided in the storage chamber door and comprising an ice making chamber wall and an ice making space formed by the ice making chamber wall and having an open front surface, the ice making chamber wall including an upper wall having an insertion hole, and a guide rib extending in the ice making space;

an ice maker provided in the ice making chamber and comprising an ice making tray having an ice making cell configured to store water and supported on the guide rib, an ejector to separate ice from the ice making cell, and a motor box coupled to the ice making tray to accommodate a motor configured to drive the ejector, the motor box having a coupling bracket and a guide groove below the coupling bracket; and a fastener configured to extend in the guide groove, through the coupling bracket and into the insertion hole of the upper wall of the ice making chamber to fasten the motor box to the ice making chamber wall, the fastener extending at an oblique angle with respect to the upper wall.

2. The refrigerator according to claim 1, wherein the fastener is fastened to be inclined in an upward direction toward the rear.

3. The refrigerator according to claim 1, wherein the upper wall of the ice making chamber comprises a coupling rib protruding toward the ice making space and having the insertion hole into which the fastener is inserted.

4. The refrigerator according to claim 1, further comprising another fastener configured to fasten the ice making tray to the ice making chamber wall to fix the ice maker to the ice making chamber wall.

5. The refrigerator according to claim 1, further comprising:

an ice bucket disposed in the ice making chamber and configured to store ice produced in the ice maker, the ice bucket comprising a bottom surface formed to be inclined from a high end portion to a low end portion; and an ice falling guide configured to guide ice falling from the ice maker to the high end portion of the bottom surface of the ice bucket.

6. A refrigerator according to claim 1, wherein the motor box has an outer wall, the coupling bracket extends from the outer wall, and the motor box has the guide groove formed in the outer wall below the coupling bracket.

7. The refrigerator according to claim 1, wherein the motor box comprises a motor box outer wall and the coupling bracket protrudes from the motor box outer wall and has a through hole through which the fastener penetrates.

8. The refrigerator according to claim 7, wherein the motor box outer wall is provided with the guide groove below the coupling bracket.

9. The refrigerator according to claim 8, wherein the coupling bracket is at a position away from an upper region of the ice making tray.

10. The refrigerator according to claim 1, wherein the ice making chamber wall comprises the upper wall, a lower wall, a left wall, a right wall, and a rear wall, and the guide rib is on the left wall or the right wall.

11. The refrigerator according to claim 10, further comprising another guide rib on the other of the left wall and the right wall of the ice making chamber in which the guide rib is not formed.

12. The refrigerator according to claim 1, wherein the ice making tray comprises a cell portion having the ice making cell formed therein, and a guide flange protruding from the cell portion to be supported on the guide rib.

13. The refrigerator according to claim 12, wherein the ice making tray comprises a pocket portion protruding from the cell portion to receive water to be supplied to the ice making cell, and the guide flange is positioned below the pocket portion.

14. The refrigerator according to claim 12, wherein the guide flange comprises a support portion formed to be placed on an upper surface of the guide rib, and a stopper portion formed to be caught on a front surface of the guide rib.

15. A refrigerator comprising:

a main body;

a storage chamber provided in the main body;

a storage chamber door rotatably coupled to the main body to open and close the storage chamber;

an ice making chamber provided in the storage chamber door and comprising an ice making chamber wall and an ice making space formed by the ice making chamber wall and having an open front surface;

an ice maker provided in the ice making chamber and comprising an ice making tray having an ice making cell configured to store water, an ejector to separate ice from the ice making cell, and a motor box coupled to the ice making tray to accommodate a motor configured to drive the ejector, the motor box having a coupling bracket and a guide groove below the coupling bracket, the ice making tray being provided with a first through hole;

a first fastener configured to extend along the guide groove, through the coupling bracket to fasten the motor box to the ice making chamber wall, the fastener extending at an oblique angle with respect to the upper wall;

a guide rib formed to protrude inwardly toward the ice making space from a left wall or a right wall of the ice making chamber wall, supporting the ice making tray, and comprising a first insertion hole corresponding to the first through hole; and a second fastener inserted into the first through hole and the first insertion hole to fasten the ice making tray to the guide rib.

* * * * *